US005090339A

United States Patent [19]

Okiura et al.

[11] Patent Number: 5,090,339

[45] Date of Patent: Feb. 25, 1992

[54] BURNER APPARATUS FOR PULVERIZED COAL

[75] Inventors: Kunio Okiura; Akira Baba; Noriyuki Oyatsu, all of Kure; Hiroyuki Kaku; Shigeki Morita, both of Hiroshima; Hironobu Kobayashi, Katsuta, all of Japan

[73] Assignee: Babcock-Hitachi Kabushiki Kaisha, Tokyo, Japan

[21] Appl. No.: 552,455

[22] Filed: Jul. 16, 1990

[30] Foreign Application Priority Data

Jul. 17, 1989 [JP] Japan ..... 1-182500

[51] Int. Cl.[5] ..... F23D 1/00; F23Q 9/00

[52] U.S. Cl. ..... 110/263; 110/265; 431/284

[58] Field of Search ..... 110/260, 261, 262, 263, 110/264, 265; 431/284

[56] References Cited

U.S. PATENT DOCUMENTS 4,434,727 3/1984 McCartney ..... 110/263 X
4,569,295 2/1986 Skoog ..... 110/261 X
4,626,195 12/1986 Sato et al. ..... 431/284 X
4,679,512 7/1987 Skoog ..... 110/264 X
4,726,760 2/1988 Skoog ..... 110/265 X

FOREIGN PATENT DOCUMENTS 0217110 8/1989 Japan ..... 110/263

*Primary Examiner*—Henry A. Bennett
*Assistant Examiner*—Christopher B. Kilner
*Attorney, Agent, or Firm*—Antonelli, Terry, Stout & Kraus

[57] ABSTRACT

A burner apparatus for pulverized coal comprises a pulverized coal supply pipe, a starter oil burner extending within the pulverized coal supply pipe to define therebetween a tubular passage through which a mixture of combustion air and pulverized coal passes into a furnace, a flame holder provided at an outer periphery of one end of the pulverizerd coal supply pipe facing to the furnace, a cylindrical member disposed in the tubular passage for dividing a part thereof into two coaxial passage parts, and a valve adapted to close an axial end opening of the cylindrical member for varying a concentration of pulverized coal in a radial outer passage part of the coaxial passage parts.

5 Claims, 9 Drawing Sheets

BURNER APPARATUS FOR PULVERIZED COAL

FIELD OF THE INVENTION AND RELATED ART STATEMENT

The present invention relates to a burner apparatus for pulverized coal, and, more particularly, to a burner apparatus for pulverized coal used in a combustion system which includes a coal mill directly connected to such burner apparatus.

Due to the change in the recent fuel situation, coal is taking the place of heavy oil. In particular, in commercial thermal power stations, larger-scale boilers have been increasing, where coal is exclusively used as their fuel.

On the other hand, in order to meet the recent power demand, the thermal power station boiler is increasing the difference between a maximum load thereof and a minimum one, and is being used with adjusting the load thereof instead of a base load operation. If such thermal power station boiler is operated with changing a boiler pressure according to the load thereof, namely a full load operation is conducted in a super critical pressure condition and a partial load operation is conducted in a sub-super critical pressure condition, a power generation efficiency in the partial load operation is increased by some percentage.

Therefore, in the thermal power stations where coal is exclusively used as their fuel, few boilers are operated in full load condition at all times. It is becoming normal that the boilers are operated with changing their loads among 75% load, 50% load and 25% load in the daytime, and they are stopped in the night time. Namely it is becoming common that the such boilers are frequently started and stopped, or they operate under daily start stop operation (hereinunder referred as "DSS operation").

Further, in the boilers for DSS operation, where coal is exclusively used as their fuel, few are operated with pulverized coal only as their fuel during an entire load range, or from a start (no load) to a full load.

Though the boilers where coal is exclusively used as their fuel, light oil, heavy oil, gas, or the like is used as their auxiliary fuel on the start or low load operation thereof.

The reason is that no heating air is fed to the coal mill so as to warm up it from the boilers where coal is exclusively used as their fuel on the start thereof. Therefore it is impossible to operate the coal mill, to grind the coal to the pulverized coal.

Further, it is impossible for the coal mill to obtain a sufficient turndown ratio on the low load operation, and the pulverized coal is poor in ignition. These are the reasons why light oil, heavy oil, gas, or the like is used in the burners of the boilers where coal is exclusively used as their fuel.

For example, in case that light oil and heavy oil are used as auxiliary fuel, at first, light oil is supplied to a burner during from the start thereof to the 15% load thereof. Subsequently, heavy oil is changed over to light oil, during from the 15% load to the 40% load. Beyond 40% load, heavy oil and pulverized coal is mixed together and supplied to the burner. The amount of heavy oil is gradually reduced, on the contrary the amount of pulverized coal is gradually increased to increase a mixture ratio of pulverized coal to the heavy oil. Finally, only pulverized coal is supplied to the burner.

In such burner which uses not only pulverized coal but also auxiliary fuel, auxiliary fuel is supplied to the burner at every start and stop of operation thereof, which occurs frequently. Therefore, the amount of auxiliary fuel to be consumed is increased. Further, in case that the load of the coal mill is low, or on the start of the coal mill, the concentration of the pulverized coal in the mixture of pulverized coal and combustion air is low. Then the ignition of the pulverized coal in the burner is unstable, thereby increasing the amount of unburnt component (carbons etc.) in the fly ash. Therefore, this increases the risk of reduction of combustion efficiency in the boiler.

OBJECT AND SUMMARY OF THE INVENTION

Accordingly, an object of the present invention is to provide a burner which can reduce the amount of auxiliary fuel and make the ignition of the pulverized coal stable on the low load operation thereof.

Further, another object of the present invention is to provide a burner which can take place a partial load operation effectively with safety.

To this end, according to the present invention, provided is a burner apparatus for pulverized coal comprising:

a pulverized coal supply pipe;

starter burner means extending within the pulverized coal supply pipe to define therebetween a tubular passage through which a mixture of combustion air and pulverized coal passes into a furnace;

a flame holder provided at an outer periphery of one end of the pulverized coal supply pipe facing to the furnace;

means for dividing a part of said tubular passage into two coaxial passage parts, sectional areas of which differ from each other; and means for varying the concentrations of pulverized coal in said passage parts.

Other objects, functions and advantages of the present invention become more clearly from the following description of the preferred embodiments described with referring to the accompanying drawings.

DETAILED DESCRIPTION OF THE PREFERRED EMBODIMENTS

Figure 1:
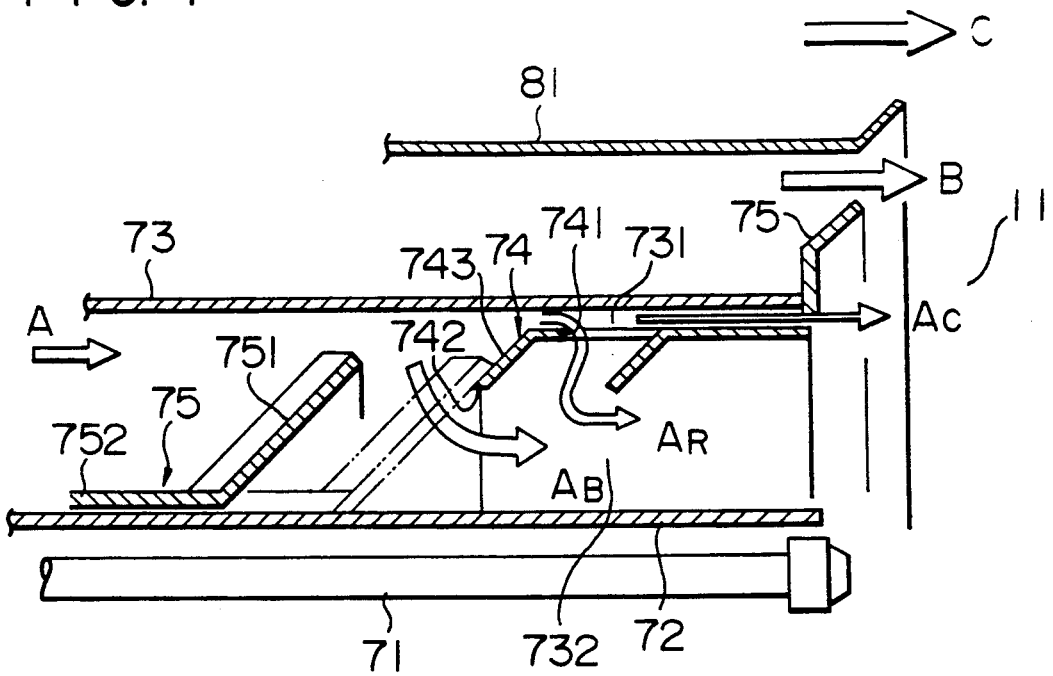
FIG. 1 is a fragmentary enlarged sectional view showing a burner according to one embodiment of the present invention.
Figure 3:
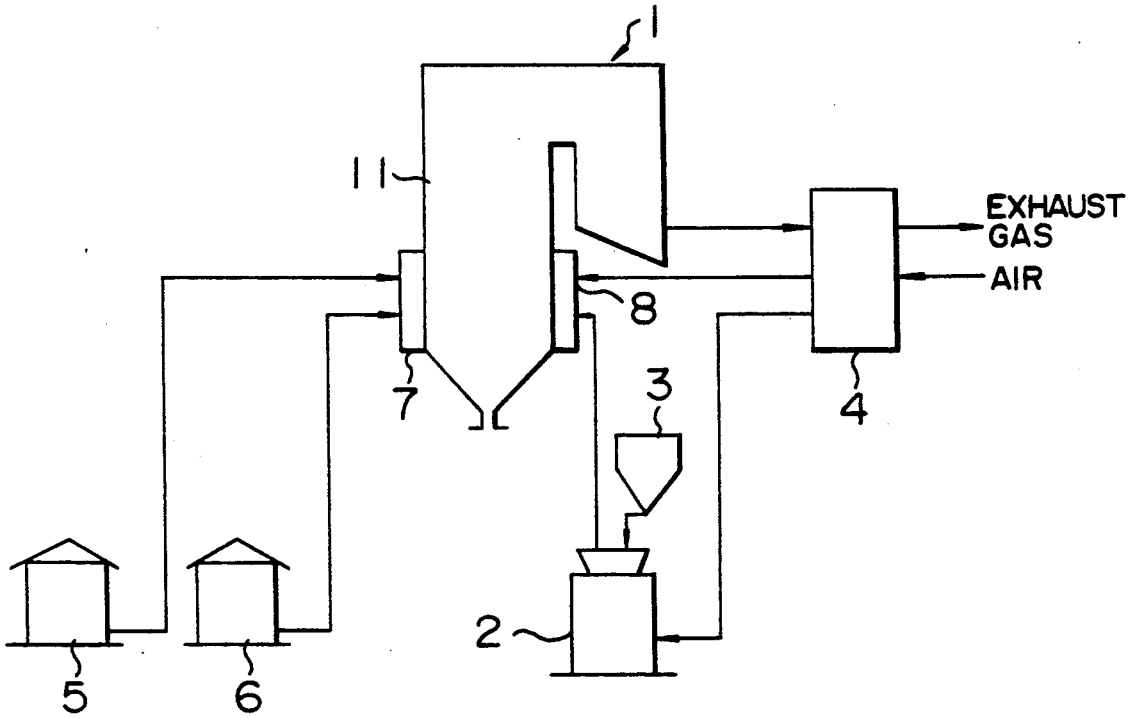
FIG. 3 is a schematic view showing a pulverized coal combustion boiler system incorporating therein the burner shown in FIGS. 1 and 2.

A burner apparatus according to an embodiment of the present invention shown in FIG. 1 is incorporated within a pulverized coal combustion boiler system shown in FIG. 3.

Figure 2:
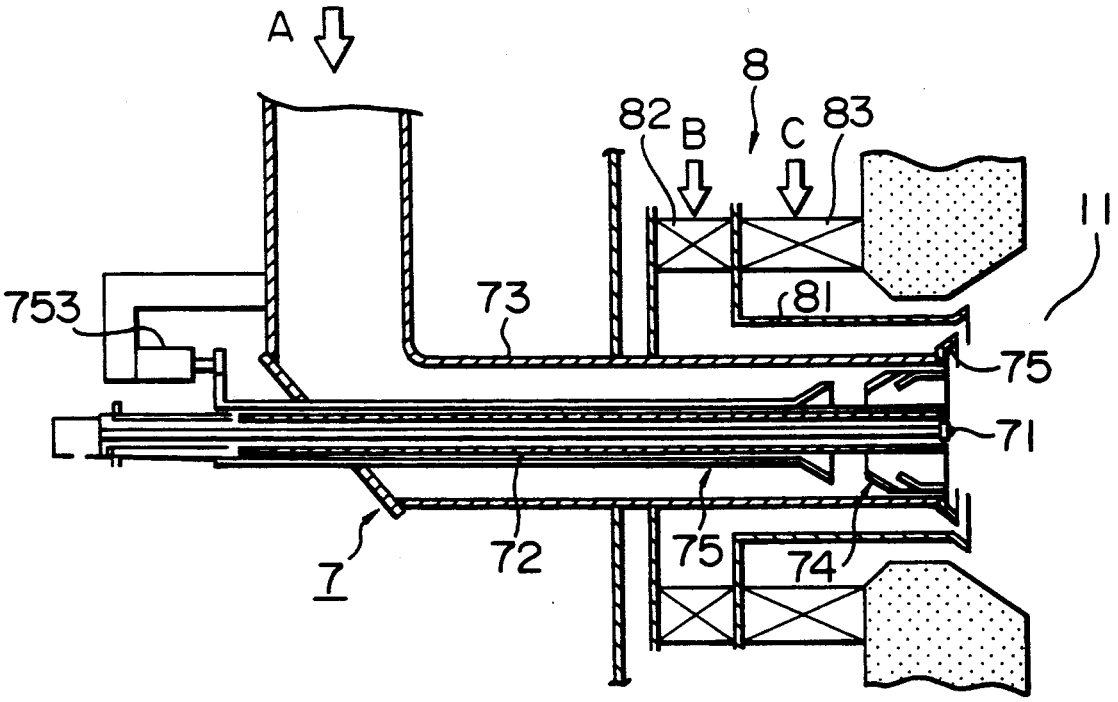
FIG. 2 is a fragmentary sectional view showing the burner shown in FIG. 1, attached to the pulverized coal combustion boiler.

The boiler system includes a pulverized coal combustion boiler 1 with a boiler furnace 11, a coal mill 2, a coal bunker 3, a heat exchanger 4, a heavy oil tank 5, a light oil tank 6, a plurality of pulverized coal burners 7, and a wind box 8. The pulverized coal burner 7 comprises, as shown in FIGS. 1 and 2, a heavy oil starter burner 71 sheathed with a guide sleeve 72 and connected to the heavy oil tank 5, a light oil ignition burner disposed adjacent to an injection end of the heavy oil starter burner 71 and connected to the light oil tank 6, and a pulverized coal supply pipe 73 disposed to surround the guide sleeve 72. The wind box 8 comprises a secondary air register 82 and a third air register 83.

Upon starting the boiler 1, at first the heavy oil starter burner 71 is ignited by the light oil ignition burner. Heavy oil is exclusively fed to the starter burner 71 to reach a load level of the boiler substantially equal to 25% to 35% of a full load thereof. After an interior temperature of the furnace 11 is raised enough, pulverized coal is fed from the coal mill 2 to furnace 11 through the pulverized coal supply pipe 73 and then is burnt in the furnace 11. Thereafter, the amount of heavy oil to be supplied to the heavy oil starter burner 71 is gradually decreased so that the pulverized coal is exclusively fed to the furnace 11.

Hot air from the heat exchanger 4 in which the hot air is heat-exchanged with exhaust gas from the boiler 1 is fed not only to the coal mill 2 as a primary combustion air but also to the wind box 8 as supplementary combustion air. The primary combustion air serves not only to remove the mist of adhering to the coal supplied from the coal bunker 3 but also to classify the ground coal in a classifier (not shown) disposed in the coal mill 2. Further, the primary combustion air carries the pulverized coal from the coal mill 2 to the pulverized coal supply pipe 73.

As shown in FIGS. 1 and 2, a tubular passage defined between the supply pipe 73 and the guide sleeve 72 is divided at an end portion thereof into two coaxial tubular sub-passages 731 and 732 by a cylindrical member 74 and a valve 75. The cylindrical member 74 is provided at a periphery thereof with a plurality of slits 741 and has a truncated conical end portion 743 with a valve seat opening 742 formed therein. The valve 75 includes a valve element 751 and a stem 752 to which the valve element 751 is attached, and is adapted to be axially moved by an actuator 753 to abut the seat opening 742 to close it. The cylindrical member 74 is so disposed that an sectional area of the radial outer sub-passage 731 is extremely small compared with that of the radial inner sub-passage 732.

The supplementary combustion air from the heat-exchanger 4 is divided in the wind box 8 into a secondary combustion air B and a third combustion air C by means of a dividing sleeve 81. They are swirled through the respective registers 82 and 83, and then supplied into the furnace 11.

The operation of the cylindrical member 74 and the valve 75 will be described hereinunder with referring to FIG. 1.

They divide a mixture A into three flows, namely a high concentration flow Ac passing through the radial outer sub-passage 731, a low concentration flow Ar passing through the radial inner sub-passage 732 via the slits 741, and a bypass flow Ab passing through the radial inner sub-passage 732 via the seat opening 742. The bypass flow Ab is controlled by moving the valve 75 axially. The truncated conical end portion 743 of the cylindrical member 74 separates the pulverized coal from the mixture A due to inertia thereof, and feeds it radial outwards.

In order to keep a steady flame in the pulverized coal burner, it is necessary to obtain a higher concentration of the pulverized coal in the mixture and to reduce a velocity of the pulverized coal.

In general, in the pulverized coal burner to which the coal mill is connected, if the load of the burner is reduced, the coal mill the grinding performance is degraded, thereby lowering the concentration of the pulverized coal in the mixture. Therefore, it is necessary to raise the concentration so as to keep a stable flame. To this end, in this embodiment, in case of a low load of the burner, the valve element 751 is moved to close the seat opening 742 as shown by a chain line. In this state, a more primary combustion air in the mixture is introduced into the radial inner sub-passage 732, then the concentration of the pulverized coal in the mixture flowing the radial outer sub-passage 731 is increased, thereby keeping the flame stable. To the contrary, in case of a high load of the burner, the coal mill operates fully to raise the concentration of the pulverized coal in the mixture. On this occasion, the valve element 751 is moved traversely to open the seat opening 742 as shown by a solid line so as to permit the mixture of a high concentration of the pulverized coal to flow both of the radial outer and the radial inner sub-passages 731 and 732. This prevents the pressure difference between the sub-passages 731 and 732 from increasing and reducing the velocity of the pulverized coal in the mixture and pressure drop of primary air which carries the pulverized coal to burner, thereby preventing the burner 7 from being damaged due to wear which is caused by collision between the pulverized coal and the burner element.

According this, since regardless of the burner load, the mixture of a high concentration of the pulverized coal is always fed radially outwardly into the furnace 11, the stably combustion can be always obtained.

Figure 4:
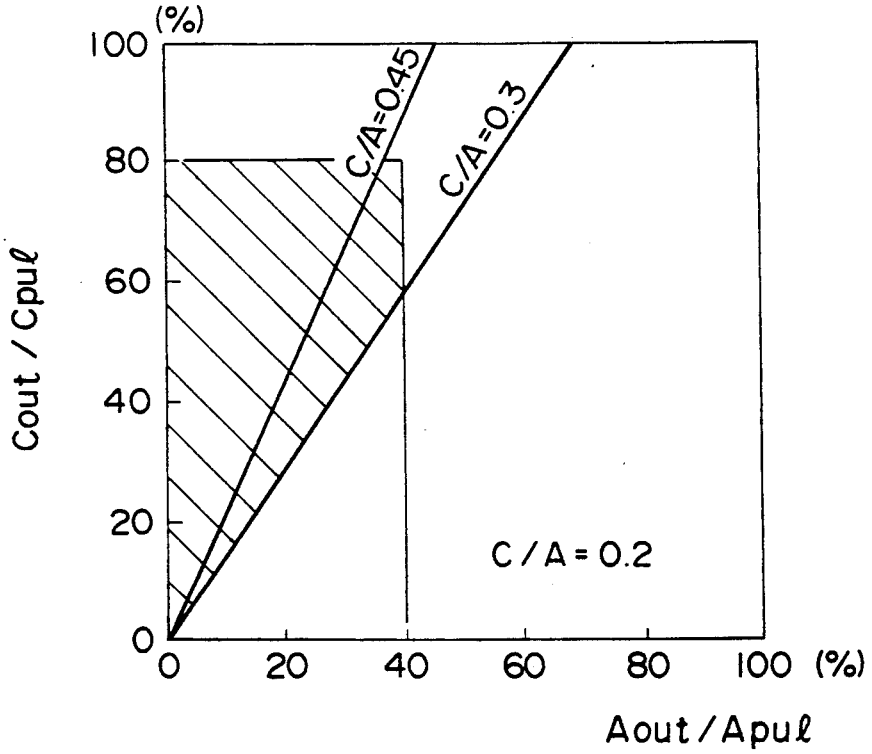
FIGS. 4 and 5 are graphs showing characteristics of the burner.
Figure 5:
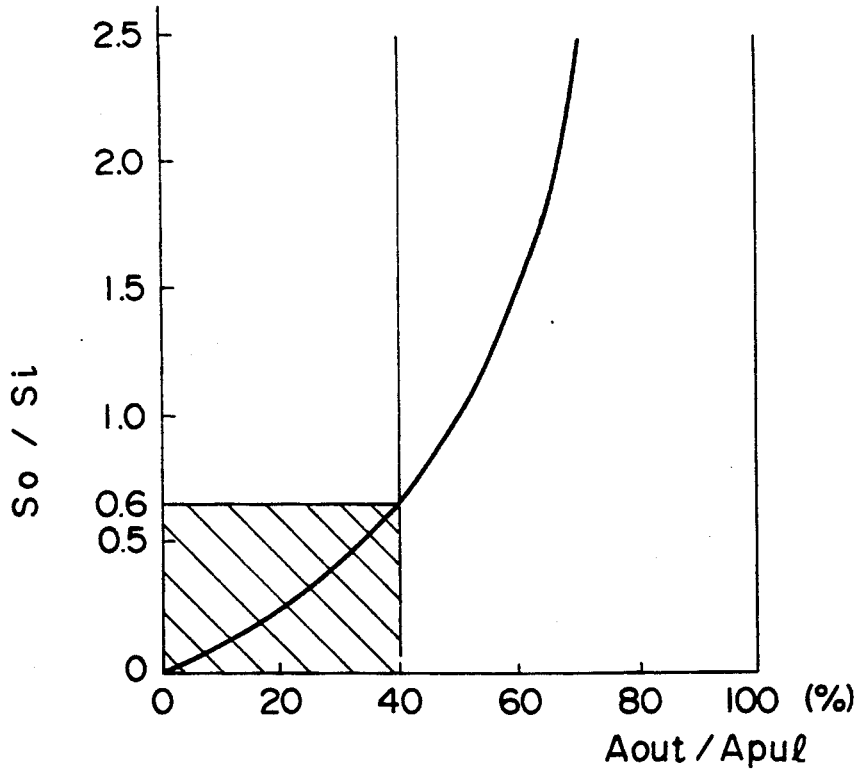

FIGS. 4 and 5 show characteristics of change of concentration of the pulverized coal in the mixture flowing the radially outer sub-passage. The axis of abscissa of FIGS. 4 and 5 represent a distribution ratio of the primary combustion air, namely, a ratio A out/A pul of the air flow rate in the mixture flowing the radial outer sub-passage 731 to the air flow rate in the mixture flowing the pulverized coal supply pipe 73. The axis of ordinate of FIG. 4 represents a concentration ratio of the pulverized coal, namely a ratio C out/C pul of the pulverized coal flow rate in the mixture flowing the radial outer sub-passage 731 to the pulverized coal flow rate in the mixture flowing the pulverized coal supply pipe 73. The axis of ordinate of FIG. 5 represents a ratio of the cross-sectional area So of the radial outer sub-passage 731 to the Si of the radial inner sub-passage 732. In the above-mentioned embodiment, in case that the mixture ratio C/A of the pulverized coal flow rate to the combustion air flow rate in the mixture flowing the pulverized coal supply pipe 73 is 0.2, if the cylindrical member 74 is so arranged that the distribution ratio A out/A pul becomes equal to or less than 40%, it becomes possible to keep the mixture ratio of the pulverized coal flow rate to the combustion air flow rate of the mixture flowing the radial outer sub-passage 731 in a high level, e.g. 30% to 45%. Namely, a high concentration ratio of the pulverized coal can be obtained in the mixture flowing in the radially outer sub-passage 731. Therefore, as apparent from FIG. 5, in order to obtain 40% or less distribution ratio A out/A pul, it is necessary to make the ratio So/Si of the cross-sectional areas less than 60%. With taking the stability of ignition into the consideration, it is practical that the mixture ratio of the pulverized coal flow rate to the combustion air flow rate in the mixture flowing the radially outer sub-passage 731 is 30% or more. Therefore, it is preferable that the relationships of the distribution ratio A out/A pul, of the concentration ratio C out/C pul, and of the cross-sectional area ratio So/Si are in the hatched areas in FIGS. 4 and 5.

Further, in this embodiment, a flame holder 75 is provided at one end of the pulverized coal supply pipe 73. Mixture of a higher concentration of pulverized coal flows along the flame holder 75 and then the flame holder 75 prevents the swirl of the supplementary combustion air from affecting the mixture from the pulverized coal supply pipe 73, thereby obtaining a steady flame. On the contrary, in the prior art with no flame holder, the supplementary combustion air affects the mixture from the pulverized coal supply pipe to cause an inverse flow. The flame is retained only in a zone in the boiler where the velocity of the inverse flow is smaller than the flame propagation velocity. Therefore, though pulverized coal is diffused fully, the flame becomes unstable.

Figure 6:
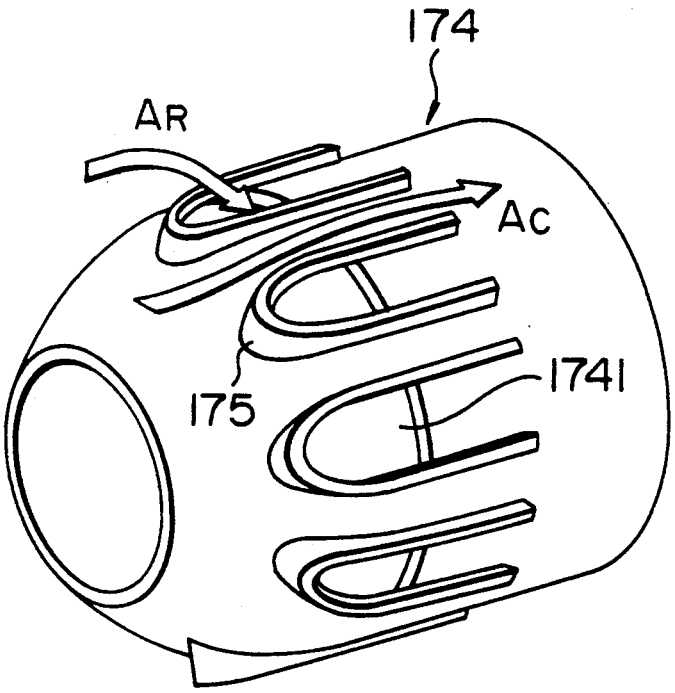
FIG. 6 is a perspective view showing a cylindrical member used in another embodiment of the invention.

A cylindrical member 174 used in another embodiment of the present invention is provided with a plurality of ribs 175 as shown in FIG. 6. The cylindrical member 74 of the above-mentioned embodiment does not have such ribs. The rib 175 is located on the truncated conical end portion adjacent to the slit 1741. The ribs 175 restrain the pulverized coal in the mixture from being introduced into the radial inner sub-passage.

Figure 7:
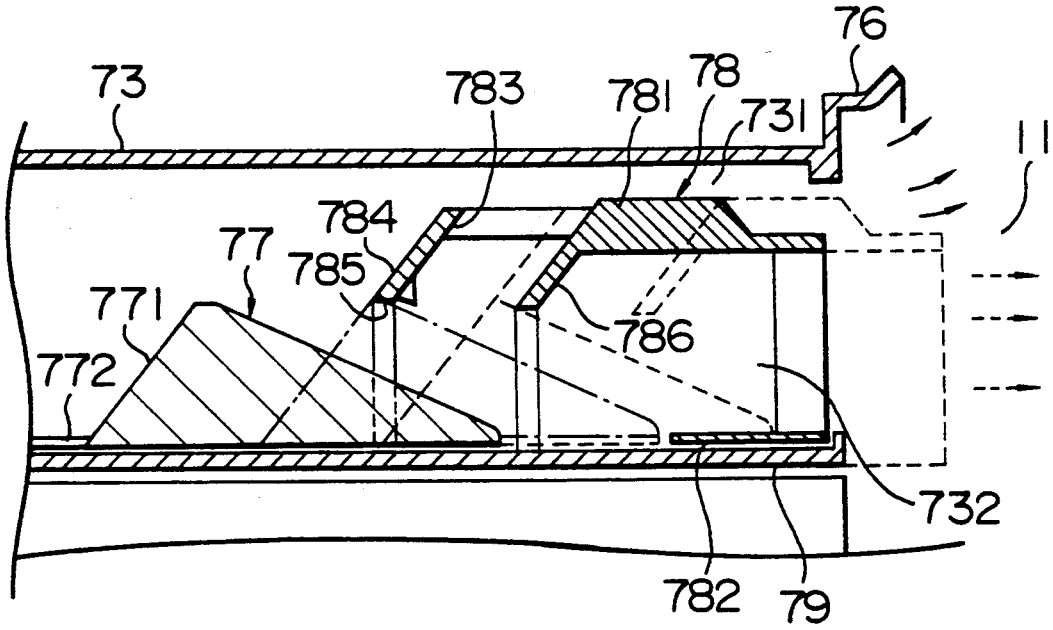
FIGS. 7 and 8 fragmentary sectional views showing a burner according to a still another embodiment of the invention.
Figure 8:
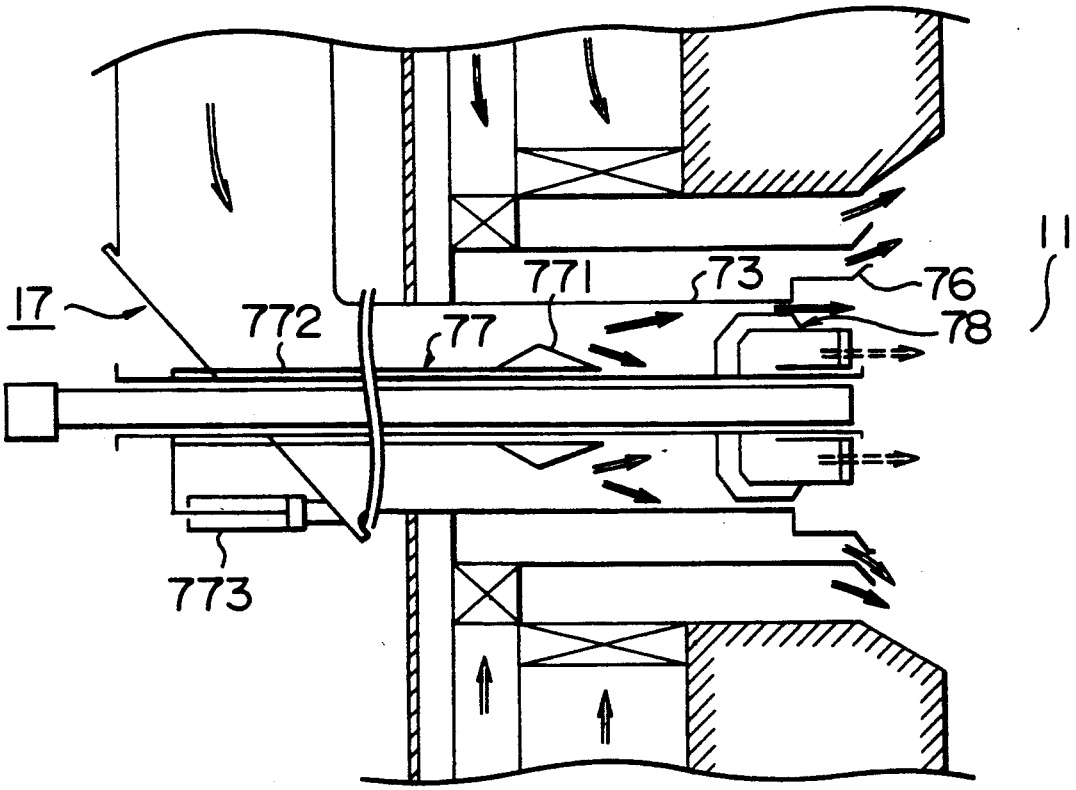

A burner 17 according to still another embodiment, as shown in FIG. 7, comprises a plug 77 instead of the valve 75. The plug 77 includes a plug element 771 in the form of a tubular, opposite ends of which are cut aslant, and a long hollow stem 772 to which the plug element 771 is attached. The plug element 771 is moved axially by an actuator 773 according to the change of burner load (FIG. 8).

A tubular member 78 having an outer peripheral wall 781 and an inner peripheral wall 782 is attached to an end portion of a guide sleeve 79. The tubular member 78 is provided at the outer peripheral wall 781 thereof with a plurality of openings 783 equiangularly spaced from each other, and has a truncated conical end portion 784 with an axial end opening 785. The inner periphery of the end opening 785 extends radial inwardly to a passage of the plug element 771. A guide tab 786 provided at a downstream side periphery of the respective openings 783 extends radial inwardly beyond the passage of the plug element 771. The tubular member 78 is axially movable. A tubular pulverized coal supply passage is divided at an end portion of the supply pipe 73 into two coaxial tubular sub-passages 731 and 732 the tubular member 78.

On a high load operation of the burner, the plug element 771 is located in a position designated by a solid line in FIG. 7. According this, pulverized coal flows through both of sub-passages 731 and 732.

To the contrary, on a low load operation of the burner, the plug element 771 is moved to a position designated by a chain line so as to close the end opening 785. On this occasion, due to the separation effect of the tubular member 78, the pulverized coal in the mixture is moved radial outwards. As a result, a rich mixture flows the radial outer sub-passage 731 and a lean mixture flows the radial inner sub-passage 732.

With an extremely low load operation of the burner, the plug element 771 is further moved to a position designated by a broken line in FIG. 7. Namely, the tubular member 78 is moved to a position designated by a broken line in FIG. 7 with the end opening 785 being closed by the plug element 771. As a result, a rich mixture flows the radial outer sub-passage 731 and a lean mixture flows the radial inner sub-passage 732. Since the tubular member 78 is extended into the furnace 11, even though an ejection velocity of the mixture from the radial outer sub-passage 731 is reduced, the ignition can take place certainly in a space between the flame holder 76 and the tubular member 78. Further, this delays mixing of mixture flowing the radial outer sub-passage 731 with mixture flowing the radial inner sub-passage 732, thereby improving the stability of flame.

The details of the above-mentioned operations will be described hereinunder with referring to FIGS. 9 to 11.

Figure 9:
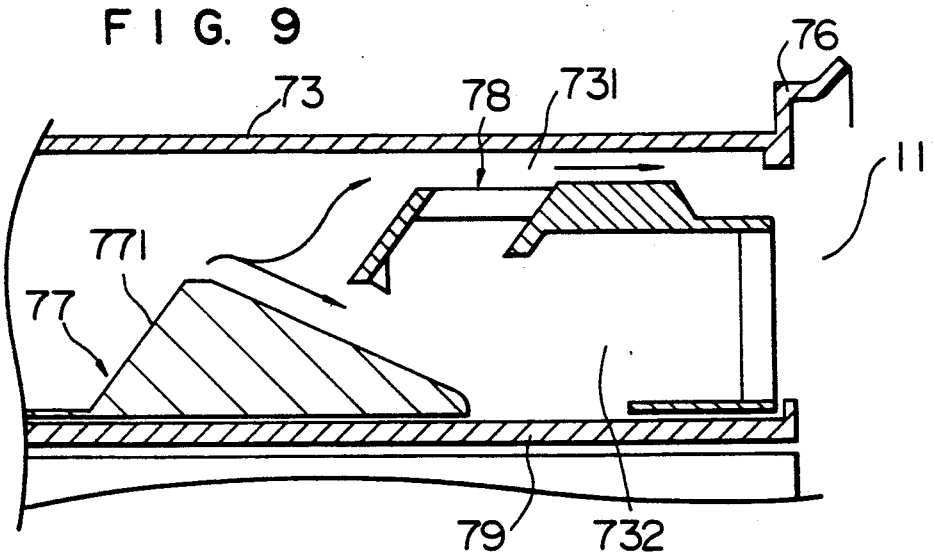
FIGS. 9 to 11 showing the plug positions according to the load of the burner.

During the high load operation of the burner, e.g. 40% load or more, as shown in FIG. 9, the plug element 771 is apart from the tubular member 78. On this occasion, the mixture supplied from the coal mill is rich and of a flow rate enough to make the flame steady. Therefore, in order to restrain the pressure loss, mixture is made to flow in the radially inner sub-passage as much as possible.

Figure 10:
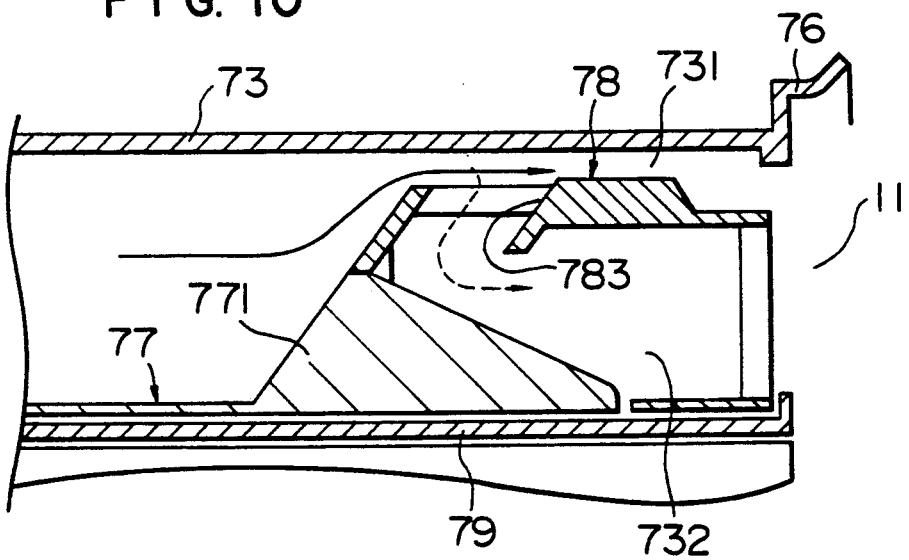

On the intermediate load operation of the burner, e.g. 25% to 40% burner load, as shown in FIG. 10, the plug element 771 is moved to close the end opening 785 of the tubular member 78. According this, the mixture flows towards the radially outer sub-passage 731. Air in the mixture is introduced into the radial inner sub-passage 732 through the openings 783, thereby rich mixture flows in the radially outer sub-passage 731 and lean mixture flows in the radially inner sub-passage 732. The rich mixture is retained by the flame holder 76, thereby improving the stability of flame. On this occasion, 70% to 90% of the pulverized coal in the mixture flowing the supply pipe 73 is fed to the radial outer sub-passage 731 and only 5% to 39% of primary air is fed to the radial outer sub-passage 731. Therefore, the concentration of the pulverized coal in the mixture flowing in the radially outer sub-passage 731 is 2 to 4.5 times as rich as that flowing the supply pipe 73, and then the mixture can be obtained, the concentration of pulverized coal in which is enough to make the flame stable.

Figure 11:
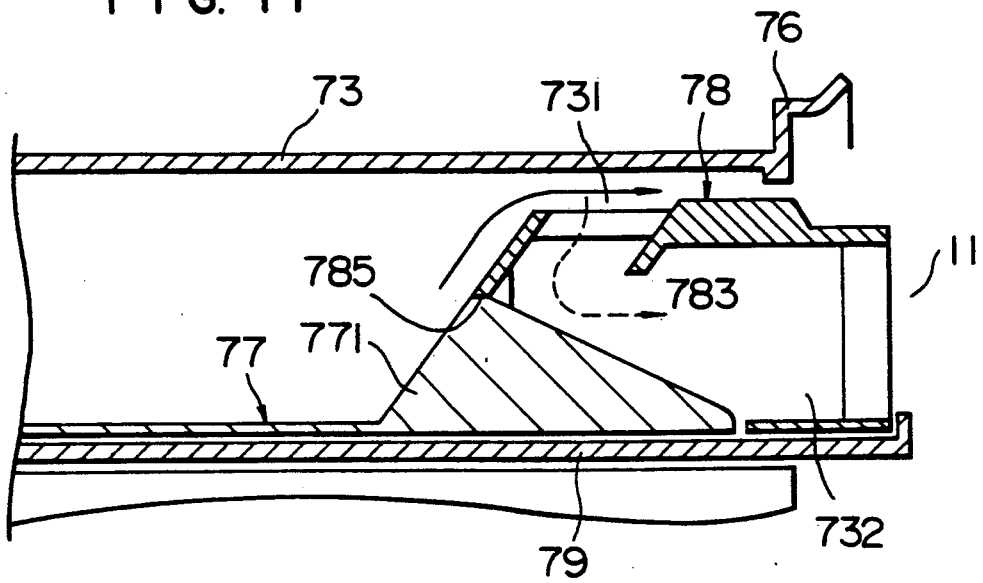

To the contrary, in the extremely low load operation of the burner, e.g. 15% to 25% burner load, as shown in FIG. 11, the tubular member 78 is moved into the furnace 11 with the end opening 785 being closed by the plug element 771. Air in the mixture is introduced into the radially inner sub-passage 732 through the openings 783, thereby rich mixture flows in the radially outer sub-passage 731 and lean mixture flows in the radially inner sub-passage 732. The tubular member 78 which extends into the furnace can delay the dilution of rich mixture ejecting from the radially outer sub-passage 731 with lean mixture ejecting from the radially inner sub-passage 732. Therefore, even during the extremely low load operation of the burner, a stable combustion can be obtained. Further, since a low velocity zone of the rich mixture is formed by the flame holder 76, the flame is stably retained.

Figure 12:
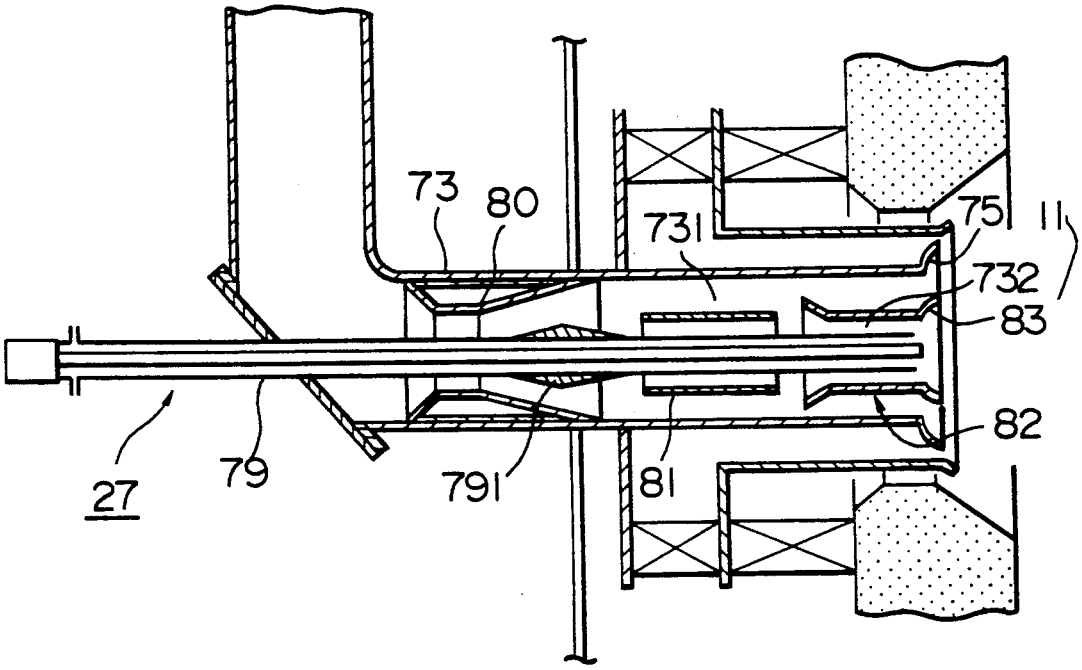
FIGS. 12 and 13 are fragmentary sectional views showing a burner according to the other embodiment of the invention.
Figure 13:
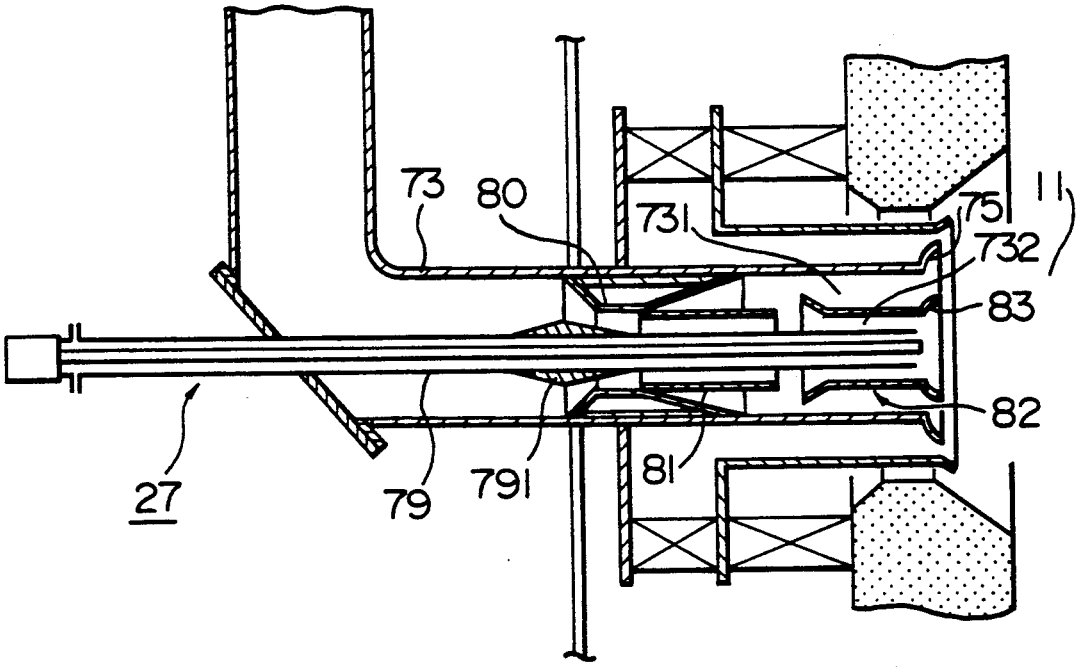

A burner 27 according to other embodiment, as shown in FIGS. 12 and 13, comprises a guide sleeve 79 provided with a pilot member 791 and a throat nozzle 80 axial movably disposed within the coal supply pipe 73 so as to cooperate with the pilot member 791. Further, the burner 27 comprises an upstream side duct 81 and a downstream side duct 82 spaced from the duct 81. Both ducts 81 and 82 are disposed within the coal supply pipe 73 and are axially aligned with each other. They cooperate with each other to divide a tubular pulverized coal passage defined between the guide sleeve 79 and the coal supply pipe 73 to provide a radially outer sub-passage 731 and a radial inner sub-passage 732.

Opposite ends of each of the pilot member 791 and the throat nozzle 80 are cut aslant. The relative positional relationship between the slant surfaces of the pilot member 791 and the throat nozzle 80 is varied so as to change the direction of the mixture to be fed into the furnace 11.

Further, in this embodiment, in addition to the flame holder 75 provided at the pulverized coal pipe 73, another flame holder 83 is provided at one end of the down stream side duct 82.

Figure 14:
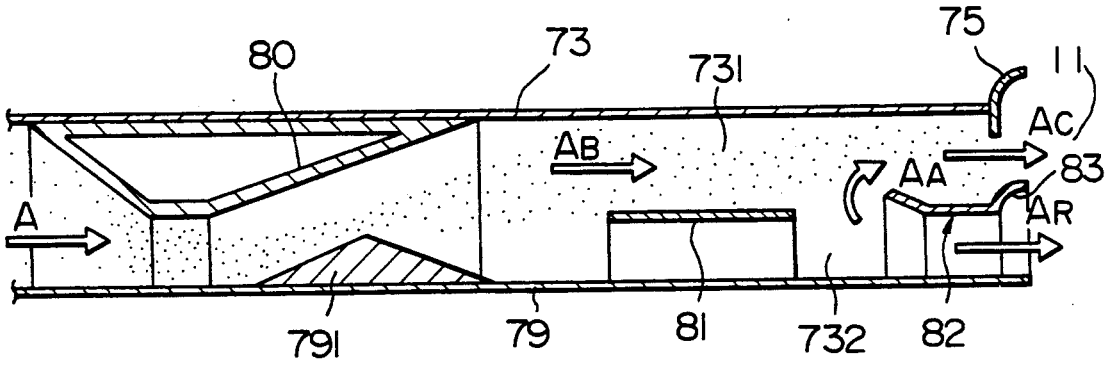
FIGS. 14 to 16 showing the flow of mixture according to the load of the burner.

On a high load operation of the burner, as shown in FIG. 14, the throat nozzle 80 is located upstream side of the pilot member 791. Accordingly, as the mixture passes through the space defined between the throat nozzle 80 and the pilot member 791, the pulverized coal is separated from the mixture due to inertia thereof and is directed to the radially outer sub-passage 731. A large part of air in the mixture flowing in the radially inner sub-passage 732 is separated therefrom and drown into the radially outer sub-passage 731 and mixed with the mixture flowing the radial outer sub-passage 731. Therefore, rich mixture flows in the radially outer sub-passage 731 and lean mixture flows in the radially inner sub-passage 732 through the ducts 81 and 82 are so inherently disposed that a larger amount of pulverized coal is fed to the radially inner sub-passage 732. The rich mixture is stably burnt the flame holder 75. On this occasion, the sub-passages 731 and 732 aren't throttled, thereby reducing a passage resistance and reducing a pressure difference in the burner and simultaneously the velocity of pulverized coal is kept a low level, thereby preventing the pulverized coal from wearing away the parts of the burner.

Figure 15:
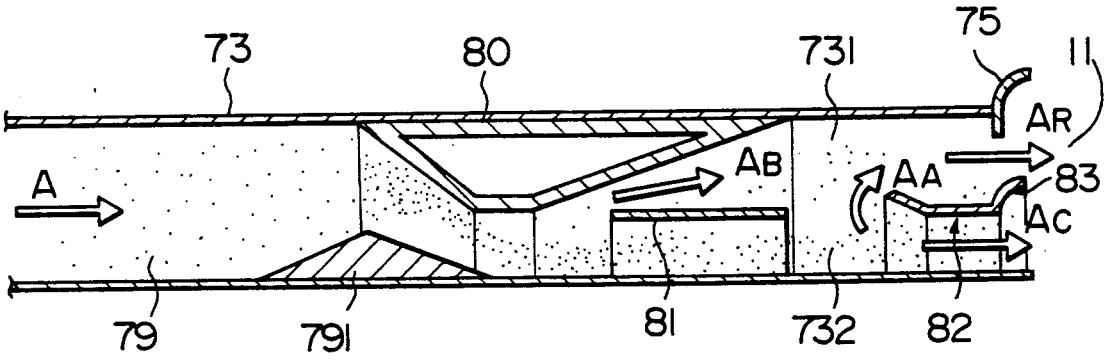

During a low load operation of the burner, as shown in FIG. 15, the throat nozzle 80 is located downstream side of the pilot member 791. Accordingly, as the mixture passes through the space defined between the throat nozzle 80 and the pilot member 791, almost of the pulverized coal is directed to the radially inner sub-passage 732. A large part of air in the mixture flowing in the radially inner sub-passage 732 is separated therefrom, and drawn into the radially outer sub-passage 731 and mixed with the mixture flowing in the radially outer sub-passage 731. Therefore, rich mixture flows in the radially inner sub-passage 732 and lean mixture flows in the radially outer sub-passage 731. The rich mixture is stably burnt by the flame holder 83.

Figure 16:
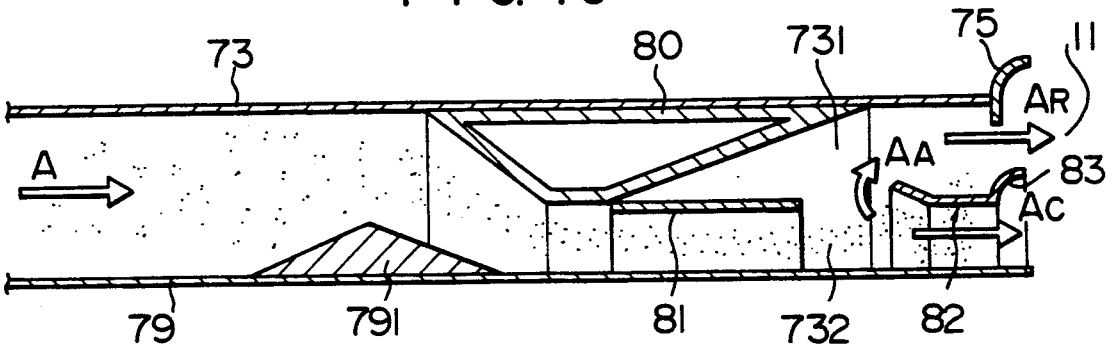

During an extremely low load operation of the burner as shown in FIG. 16, the throat nozzle 80 is located on a downstream side of the pilot member 791 and abutted against the upstream side duct 81. Accordingly, all of pulverized coal is directed to the radial inner sub-passage 732. Therefore, rich mixture flows the radial inner sub-passage 732 and is stably burnt by the flame holder 83.

In order to obtain a good combustion in the burner, it is preferable that the ducts are so arranged as to meet the following relationships, namely the ratio $(So+Si)/S$ is between 0.5 and 0.9, the ratio $Si/(Si+So)$ is less than 0.4, and Sr is greater than So, where So represents a minimum cross-sectional area of the radial inner sub-passage 732; Si represents a minimum cross-sectional area of the radial outer sub-passage 731; and Sr represents a minimum area of the slit between the ducts 81 and 82.

Figure 17:
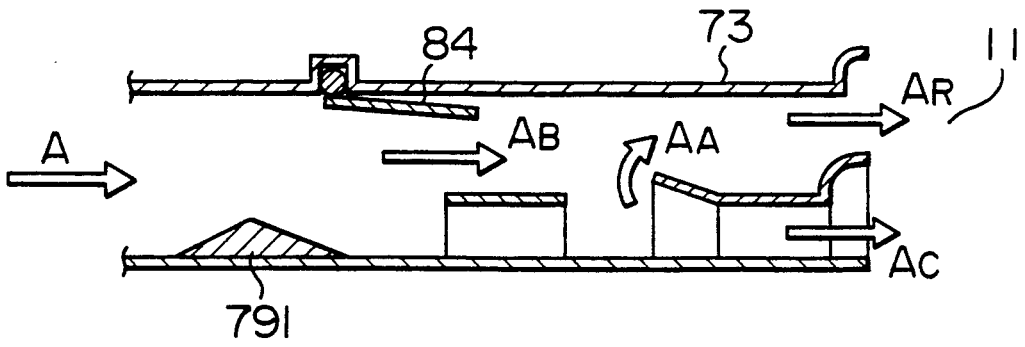
FIGS. 17 and 18 are fragmentary sectional views showing the burners according to another embodiments of the invention, respectively.
Figure 18:
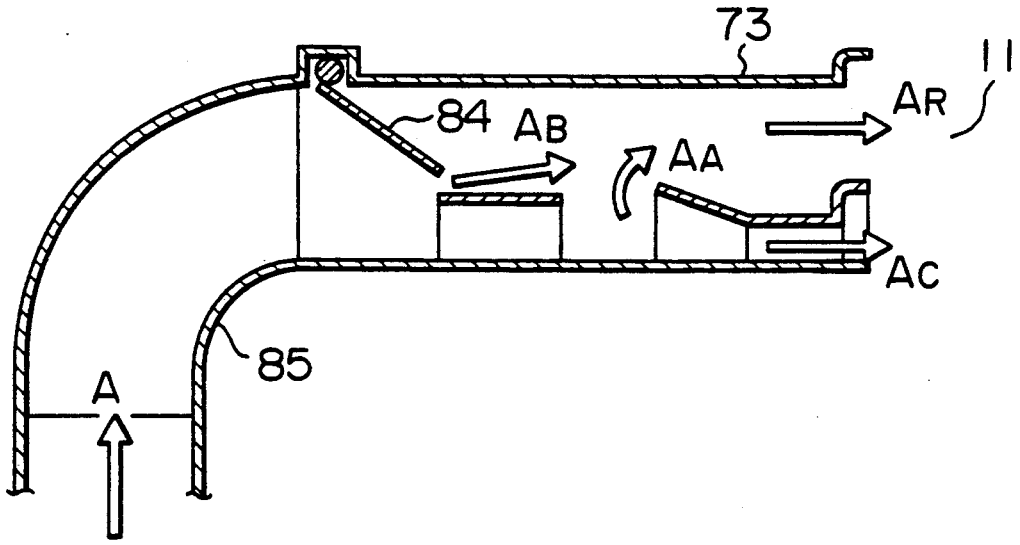

Burners according to still other embodiments of the present invention are shown in FIGS. 17 and 18, respectively.

In the burner shown in FIG. 17, a pivotable deflector 84 is used instead of the throat nozzle 80. The deflector 84 is pivoted according to the load of the burner so as to change the direction of the mixture from the coal mill.

In the burner shown in FIG. 18, the pivotable deflector 84 and a bent duct 85 are substituted for the throat nozzle 80 and the pilot member 791, respectively.

It should be understood that these burners can enjoy the meritorious advantages of the above-mentioned embodiments as well.

What is claimed is:

1. A burner apparatus for pulverized coal comprising:
a pulverized coal supply pipe;
starter means extending within said pulverized coal supply pipe to define therebetween a tubular passage through which a mixture of combustion air and pulverized coal passes into a furnace;
a flame holder provided at an upper periphery of one end of said pulverized coal supply pipe facing to said furnace;
means for dividing a part of said tubular passage into two coaxial passage parts, sectional areas of which differ from each other; and
means for varying concentrations of pulverized coal in said passage parts including a bypass passage part for interconnecting a radially inner passage part of said coaxial passage parts and the remainder of said tubular passage, and valve means for varying an opening degree of said bypass passage part.

2. A burner apparatus according to claim 1, wherein said dividing means include a cylindrical member disposed within said tubular passage so as to make a radial dimension in a cross-section of said radially outer passage part smaller than that of said radially inner passage part, and wherein said bypass passage part is provided in said cylindrical member.

3. A burner apparatus according to one of claim 1 or 2, wherein said dividing means and said varying means are axially movable.

4. A burner apparatus according to one of claims 1 or 2, wherein said dividing means includes a cylindrical member disposed within said tubular passage, and wherein said burner apparatus further comprises an additional flame holder provided at an outer periphery of one end of said cylindrical member facing said furnace and means for deflecting a direction of said mixture.

5. A burner apparatus according to claim 4, wherein said deflecting means include a pair of tubular members which are relatively and axially movable and disposed coaxially, and each of which tubular members has sloped surfaces which cooperate with those of the other one to deflect a direction of said mixture.

* * * * *